United States Patent [19]

Oilar

[11] Patent Number: 5,009,535

[45] Date of Patent: Apr. 23, 1991

[54] COMBINATION WRITING IMPLEMENT AND TOOTHPICK DISPENSER

[76] Inventor: Clayton D. Oilar, P.O. Box 64, Cedarville, Calif. 96104

[21] Appl. No.: 565,456

[22] Filed: Aug. 10, 1990

[51] Int. Cl.[5] ..... B43K 29/00; B65D 83/02

[52] U.S. Cl. ..... 401/195; 221/190; 221/254

[58] Field of Search ..... 221/190, 191, 220, 254; 401/195

[56] References Cited

U.S. PATENT DOCUMENTS

| | | | |
|---|---|---|---|
| 1,310,257 | 7/1919 | Stiles | 401/195 |
| 1,490,892 | 4/1924 | Rod | 211/88 |
| 1,686,255 | 10/1928 | Robergel | 221/190 |
| 1,725,064 | 8/1929 | Easton | 401/195 X |
| 2,233,120 | 2/1941 | Andonov | 221/190 |

FOREIGN PATENT DOCUMENTS

| | | | |
|---|---|---|---|
| 453889 | 12/1949 | Italy | 221/190 |

*Primary Examiner*—Richard J. Johnson

[57] ABSTRACT

A toothpick dispenser and pen combination combined in an elongated tubular two-piece telescoping housing having a first housing member and a second housing member. The first housing member is structured for storing and dispensing toothpicks, with the oppositely disposed second end structured as a writing implement. The toothpick storage chamber of the first housing member is structured with a concave floor and a dish-shaped curved ceiling. The ceiling contains a central dispensing aperture, sized for passage of at least one toothpick, while the concave floor contains a central centering pin aperture sized for passage of a toothpick centering pin. The centering pin projects upward into the toothpick storage chamber as the first housing member is depressed downward over the second housing member. The distal end of the centering pin is structured to engage one end of a toothpick as it is projected upward, raising the top end of the toothpick upward and out the dispensing aperture. The dispensing aperture is structured to temporarily retain the toothpick as the first housing member is returned to its original position.

1 Claim, 3 Drawing Sheets

COMBINATION WRITING IMPLEMENT AND TOOTHPICK DISPENSER

BACKGROUND OF THE INVENTION

1. Field of the Invention:

This invention relates to toothpick dispensers in general, and more precisely to a writing pen and toothpick dispenser combination.

2. Description of the Prior Art:

Toothpicks are well known, and are widely used by many people today. Some restaurants even provide their patrons with complimentary toothpicks. However the majority of food establishments, especially fast food restaurants, do not. This situation has prompted many people to carry their own supply of toothpicks. Loose toothpicks, in a purse or pocket, tend to get dirty, broken and can end up damaging clothing or injuring the person. Toothpick containers are generally inconveniently sized for carrying in a pocket and take up valuable space. Even containers having lids can open accidentally, spilling the toothpicks. A conscious effort must also be made to remember to take the items along when leaving the house, especially when carried in a coat or shirt pocket. Providing a toothpick dispenser which can be easily and conveniently carried by the user, dispense a single toothpick without removal of a cap, and one which would be less likely to be forgotten and left behind, would be a significant improvement over conventional toothpick containers. Various types of toothpick dispensers are known which dispense a single toothpick at a time. For example, U.S. Pat. No. 2,233,120, issued to C. Andonov on Feb. 25, 1941, for a dispensing device comprised of a two piece telescoping housing in which a single toothpick is ejected out an upper aperture when the top portion of the housing is depressed. The Andonov device appears to be designed for table top use and not as a portable device to be carried in a pocket.

U.S. Pat. No. 1,686,255, issued to Robergel on Oct. 2, 1928, teaches a distributor for slender articles of elongated shape, such as needles. The upper portion of the housing is raised, with the point of a single needle engaging in a central post. When the upper portion of the housing is lowered the needle is retained on the central post, to be grasped by the user.

U.S. Pat. No. 4,522,314, granted to Nelson on June 11, 1985, shows a telescoping toothpick dispenser which ejects a single toothpick out the top of the device when the top section of the housing is raised.

All the past art patents show devices having open top apertures sized for passage of the toothpicks. Were these devices to be carried in a pocket or purse, they would eventually become positioned on their side, or even inverted, where a toothpick, or portion thereof, could be partially or completely ejected. This would be a disadvantage since the projecting toothpick could damage clothing or injure the user. Both the Andonov and Nelson devices appear structured for use only as table top dispensers and not for easy storage or transportation in clothing pockets or purses. The Andonov device shows a dispenser in which the upper housing must be manually retained in position while the toothpick is grasped, else the toothpick will be drawn back into the interior of the housing. This feature would be inconvenient when used with a portable device since the portable device would generally be operated with the hands only, not placed on a table top for bracing.

Were the Andonov device used with the hands only, one hand would be used to hold the lower housing while the upper housing manipulated the top housing to eject the toothpick. When the top housing was released to grasp the toothpick, the toothpick would recede back into the housing. Although the past art devices of Robergel and Nelson, have solved this problem by retaining the toothpick, or slender article, on the end of a central post when dispensed, the dispensing apertures of these two housings are apparently not designed to engage and retain the toothpicks or articles should the housings be inverted or tipped over.

The only function of these past art devices is for storage and dispensing of toothpicks, or similar items. By combining the storage of the toothpicks in an item that is generally already carried by the user would not only solve the problem of storage space, but would also help eliminate the problem of the user inadvertently forgetting to take the toothpicks along when leaving home.

SUMMARY OF THE INVENTION

The present invention provides a toothpick dispenser and writing implement both combined within a single penlike housing. The size of the housing is relative to standard sized pens and therefore does not consume a great deal of storage space, either in the purse or pocket of the user. Since pens are generally a commonly carried item and located in conveniently accessible areas by the user, such as a shirt pocket, the toothpicks will generally be close at hand. Additional storage space is therefore not required for the toothpicks. The upper portion of the pen housing is structured for dispensing of the toothpicks with the lower section containing a writing implement, such as a ball point pen or graphite pencil. When the upper housing is depressed a single toothpick is partially ejected from the top of the housing where it is retained by a modified dispensing aperture, even when the upper housing is returned to the storage position. This allows one-handed operation of the device if necessary. An internal compression spring returns the upper housing to its normal position. A removable snap-on cap allows refilling of the toothpicks, with the modified dispensing aperture on the cap also preventing the toothpicks from falling out of the aperture should the housing be inverted while stored in the pocket or purse.

Therefore, a primary object of the invention is to provide a toothpick dispenser which occupies very little storage space, dispenses toothpicks one at a time, and also functions as a writing implement.

Another object of the invention is to provide a toothpick dispenser which, when in combination with a pen, reduces the problem of the dispenser being inadvertently forgotten or misplaced.

A further object of the invention is to provide a toothpick dispenser which will retain the partially ejected toothpick within the dispensing aperture until the user removes it, thus allowing single handed usage, with the user grasping the projecting toothpick with his teeth.

Other objects and advantages will become apparent from a reading of the following specification and comparison with accompanying drawings.

DESCRIPTION OF THE PREFERRED EMBODIMENT

Figure 1:
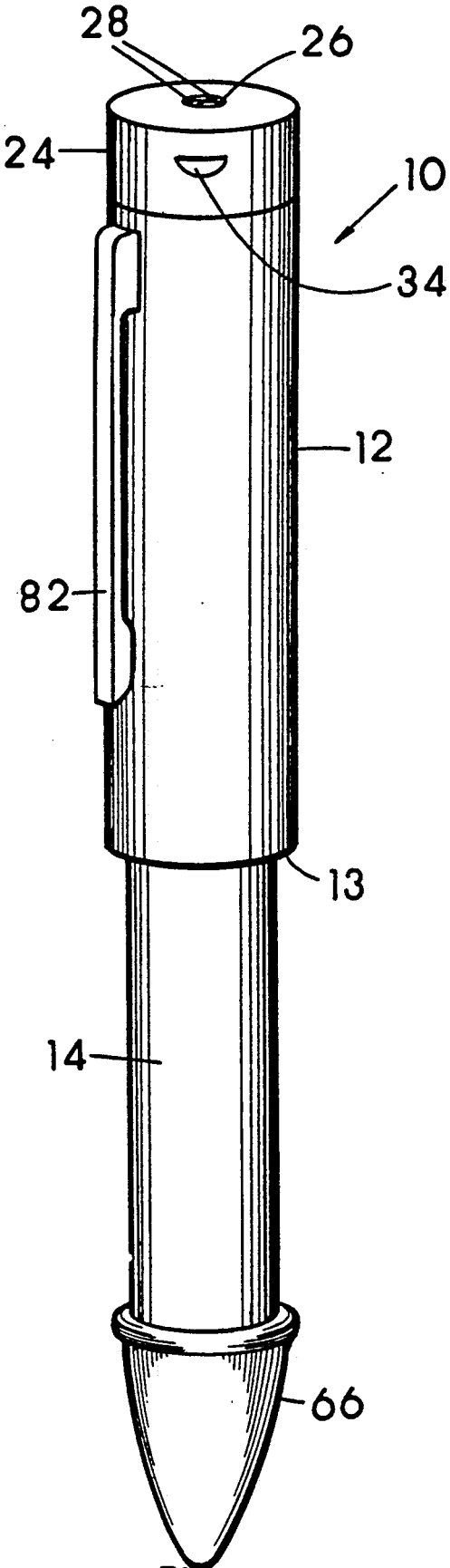
FIG. 1 is a top perspective view of the assembled invention.
Figure 2:
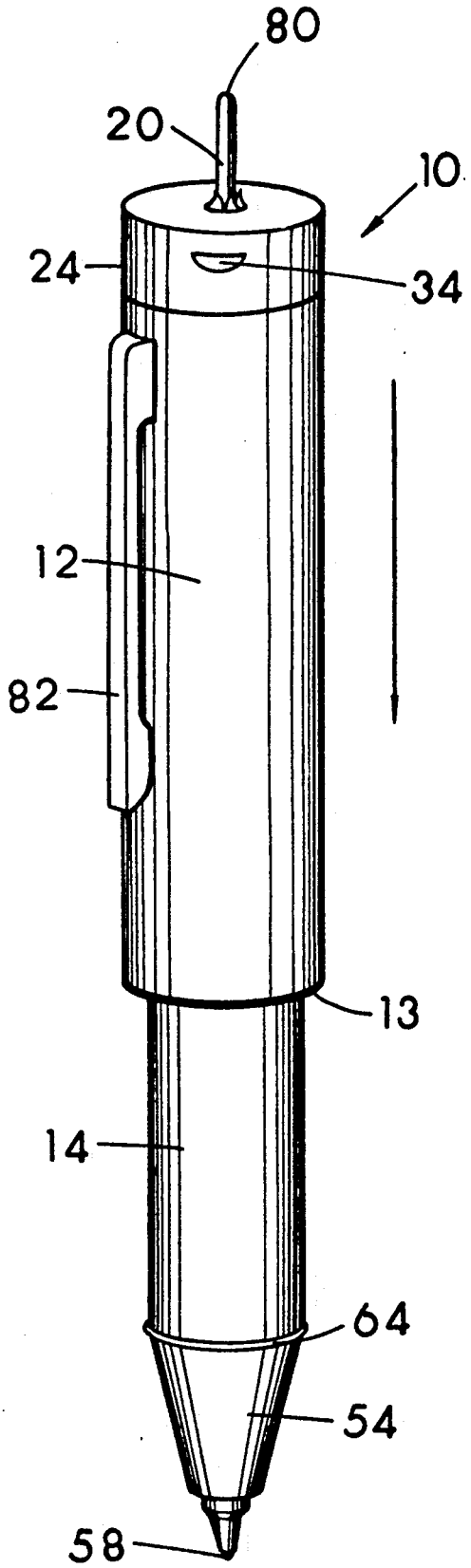
FIG. 2 is a top perspective view of the device in use dispensing a toothpick. The writing tip cover or protector is shown removed from the lower end of the housing.
Figure 3:
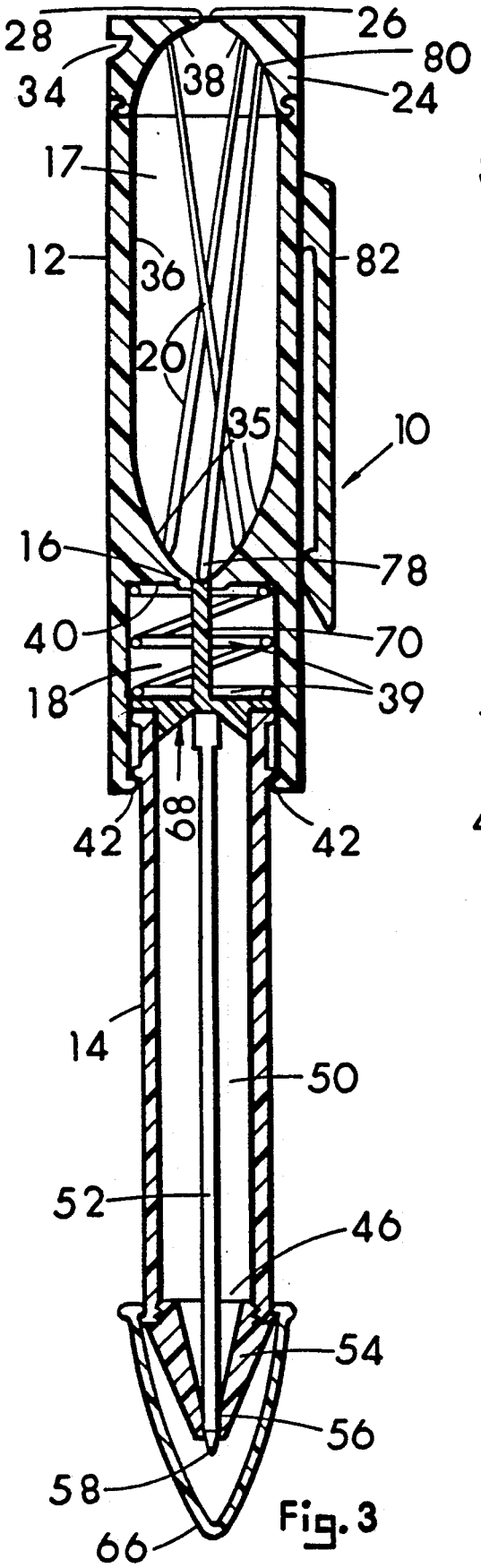
FIG. 3 is a cross-sectional side view of the assembled invention illustrating the toothpick dispenser in the storage or non-use position.
Figure 4:
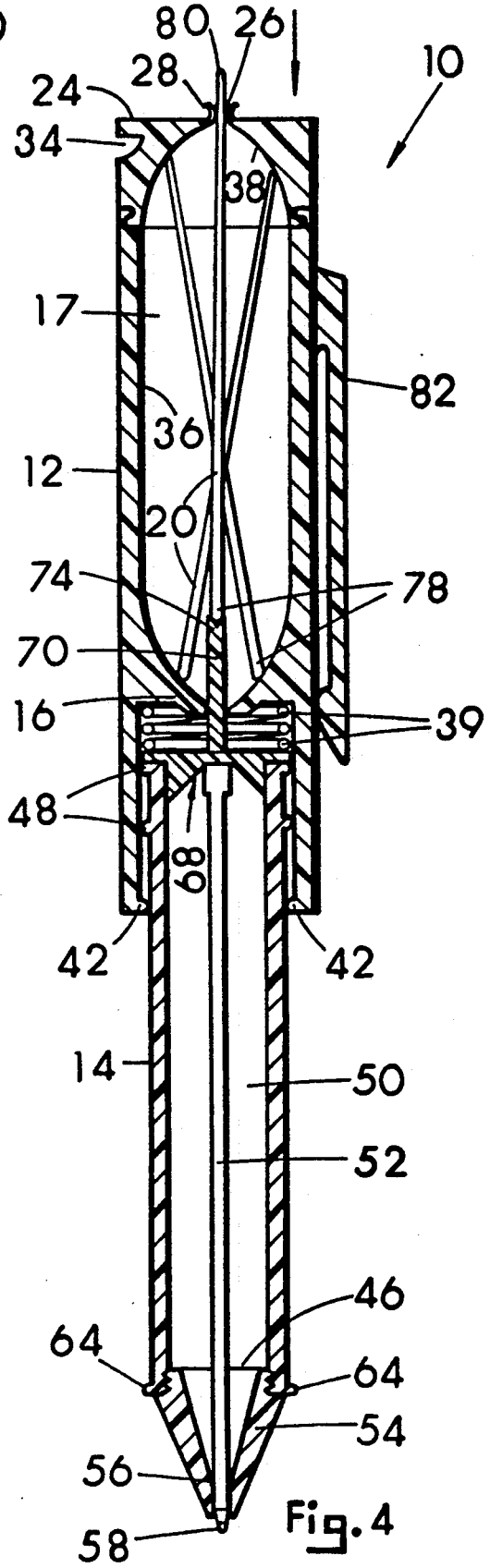
FIG. 4 is a cross-sectional side view of the invention, less writing tip protector, illustrating the toothpick dispenser in the process of dispensing a toothpick.
Figure 5:
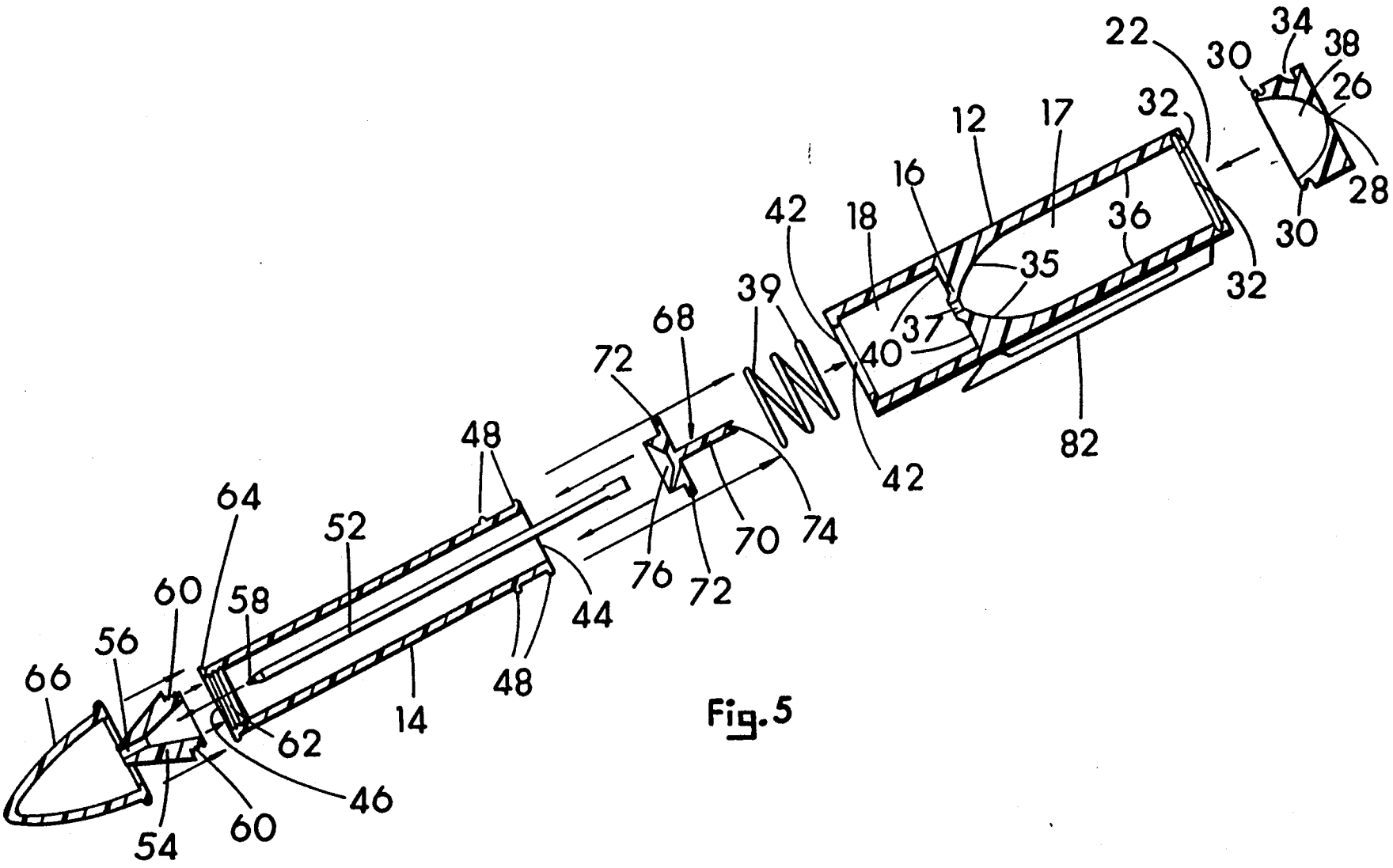
FIG. 5 is a cross-sectional side view of the component elements of the invention in their relative position of assembly.

Referring now to the drawings where the preferred embodiment of the invention is illustrated in detail. Pen toothpick dispenser 10 is comprised of a two piece telescoping tubular housing having a top or first housing member 12 and a bottom or second housing member 14. First housing member 12 is an open ended hollow tube having two oppositely disposed terminal open ends 13 and an apertured interior divider 16 forming two interior compartments. The larger or upper compartment is referred to as toothpick storage chamber 17, and the second compartment is spring retainer compartment 18. Toothpick storage chamber 17 is sized for lengthwise retention of conventionally sized toothpicks 20. The terminal open end 13 of toothpick storage chamber 17, referred to as toothpick insertion opening 22, is closeable with snap-on cap 24. Snap-on cap 24 is basically a short cylindrical member, of the same outer diameter as first housing member 12, having an upwardly inwardly curved or dished bottom surface and a flat top surface. The apex of the dished bottom surface of snap-on cap 24 is positioned adjacent the flat top surface, leaving a very thin septum between the two surfaces. Centered in the apex of snap-on cap 24 is toothpick dispensing aperture 26 which is basically an open aperture covered with four thin flexible flaps 28. Flaps 28 are basically extensions of the previously mentioned septum. The outer edge of the dish shaped bottom surface of snap-on cap 24 is rimmed with an annular ring, cap retainer first ring 30, which snaps into cap retainer second ring 32 located on the outer edge of toothpick insertion opening 22. Located on the exterior annular side wall of snap-on cap 24 is thumbnail notch 34, which is sized for insertion of a portion of the user's thumbnail, serving as a gripping notch for easy removal of snap-on cap 24 from first housing member 12. Interior divider 16, of first housing member 12, forms the bottom interior floor 35 of toothpick storage chamber 17. The vertical interior side walls 36 of toothpick storage chamber 17 curve inward and downward and merge into interior divider 16, forming a concave or dished floor 35. Floor 35 has a central aperture known as centering pin aperture 37. In the upper portion of toothpick storage chamber 17, interior side walls 36 extend vertically upward and begin curving inwardly at the abutment of snap-on cap 24. The bottom interior dished surface of snap-on cap 24 forms the top interior concave ceiling 38 of toothpick storage chamber 17. Toothpick dispensing aperture 26, of snap-on cap 24, is in direct linear alignment with centering pin aperture 37. The second chamber of first housing member 12, spring retainer compartment 18, is sized for retaining compression spring 39. Spring retainer compartment 18 has a terminal open end 13 and an oppositely disposed closed end, spring abutment 40, which is the bottom surface of interior divider 16 opposite to that of floor 35. Spring abutment 40 is substantially flat for bracing spring 39. Terminal open end 13 of spring retainer compartment 18 is sized for insertion over second housing member 14 by means of snap-on attachment rings. The internal edge of terminal open end 13 of spring retainer compartment 18 is affixed with an inherent annular ring, top housing retainer ring 42, which will be further explained later in the specification. Second housing member 14 is basically an elongated hollow tube having a first open end 44 adapted for releasable connection to first housing member 12, and a second open end 46, which is adapted for writing with the affixment of writing implement 52. The exterior annular side wall of second housing member 14, adjacent first open end 44, is affixed with two parallel rings designated bottom housing retainer rings 48, which are adapted for releasable snap-on connection with top housing retainer ring 42 of first housing member 12. The two bottom housing retainer rings 48 help to longitudinally stabilize the connection of both housings 12 and 14 by preventing rocking or pivoting as may result with only one bottom housing retainer ring 48. The interlocking rings 42 and 48 also allow telescopic connection of both housings 12 and 14, being limited longitudinally in movement by abutment of first open end 44 against spring abutment 40, and then by abutment of top housing retainer ring 42 against the outer bottom housing retainer ring 48. The interior of second housing member 14 is referred to as writing implement housing 50 and serves to retain the major portion of writing implement 52. Writing implement 52 can include ball point pens, felt tip pens, graphite pencils and the like. Writing implement 52 is retained within writing implement housing 50, on second open end 46, by removable writing tip support 54. Writing tip support 54 is a cone shaped threaded end cap having a central writing tip aperture 56 sized for retaining and stabilizing writing tip 58 of writing implement 52. Writing tip support 54 has exterior threads 60 which are sized for engagement with interior threads 62, located on second open end 46 of second housing member 14. The exterior annular side wall of second housing member 14, adjacent second open end 46, contains an integral attachment ring 64 for removable attachment of writing tip protector 66. Writing tip protector 66 is a cone shaped shell structured to removably snap over attachment ring 64, and serves to protect writing tip 58 from damage and also protects other surfaces from inadvertent marking from writing tip 58.

First open end 44 of second housing member 14 is affixed with centering pin support base 68. Centering pin support base 68 includes cylindrical centering pin 70 and annular base plate 72. Centering pin 70 has two ends, one being an attachment end affixed perpendicular to annular base plate 72 and the other is referred to as distal end 74. Distal end 74 is concave in shape and structured to retain one end of toothpick 20. Annular base plate 72 has a substantially flat top surface to which centering pin 70 is affixed perpendicular thereto. The bottom surface of annular base plate 72 contains a narrow flange 76 sized for insertion into writing implement housing 50 while annular base plate 72 rests on the edge of first open end 44 of second housing member 14. Flange 76 generally has vertical annular exterior sides and an upwardly inwardly beveled annular interior wall. When assembled, one end of compression spring 39 abuts the surface of annular base plate 72 with the opposite end abutting the bottom surface of interior divider 16 or spring abutment 40, in spring retainer compartment 18.

A preferred order of assembly of pen toothpick dispenser 10 first includes insertion of flange 76 of centering pin support base 68 into first open end 44 of second housing member 14. Flange 76 can be removably or permanently affixed to second housing member 14. Writing implement 52 is then inserted into writing implement housing 50 from second open end 46, with writing tip 58 extending outward from second open end 46, and the opposite end engaging the center of the beveled interior wall of flange 76. Writing tip support 54 is then affixed to second open end 46 with the use of exterior threads 60 and interior threads 62, with the very end of writing tip 58 extending out from writing tip aperture 56 of writing tip support 54. The secure abutment of both ends of writing implement 52 helps to prevent writing tip 58 from becoming disengaged with writing tip support 54. Compression spring 39 is then inserted into spring retainer compartment 18 of first housing member 12. Centering pin support base 68, now affixed into first open end 44, is then inserted into spring retainer compartment 18 with centering pin 70 aligned with centering pin aperture 37. Affixed centering pin support base 68 is further advanced into spring retainer compartment 18 a sufficient distance to snap both bottom housing retainer rings 48 over and past top housing retainer ring 42. Both housing members 12 and 14 are now movably affixed together. Telescopic movement of both housing members 12 and 14 is allowed, as there is some distance between annular base plate 72 and spring abutment 40, being limited only by compression spring 39. Compression spring 39 maintains constant tension against second housing member 14 to maintain a stable expanded position until first housing member 12 is depressed and telescoped downward over second housing member 14. To fill toothpick storage chamber 17 snap-on cap 24 is removed and a number of toothpicks 20 are inserted into toothpick storage chamber 17, with snap-on cap 24 then being replaced.

To dispense toothpick 20, first housing member 12 is pressed downward, telescoping first housing member 12 over second housing member 14. In this process, centering pin 70 projects upward through centering pin aperture 37. The end of toothpick 20 adjacent floor 35, designated bottom end 78 of toothpick 20, slides down the inward sloping concave floor 35 of toothpick storage chamber 17 when pen toothpick dispenser 10 is held in a generally vertical position, as is necessary for dispensing toothpick 20. Bottom end 78 of toothpick 20 is directed into the concave distal end 74 of centering pin 70. When centering pin 70 is projected upward, bottom end 78 of toothpick 20 is engaged within distal end 74. The top end 80 of toothpick 20 then rides along the interior walls of ceiling 38, of toothpick storage chamber 17, being pushed upward into dispensing aperture 26 as centering pin 70 is projected upward. The four flexible flaps 28, covering dispensing aperture 26, fold upward to allow passage of top end 80 of toothpick 20. As centering pin 70 projects only a short distance through centering pin aperture 37, top end 80 of toothpick 20 extends only a short distance upward past the exterior surface of snap-on cap 24. First housing member 12 is then released where it returns to its original extended position with the use of compression spring 39, recessing centering pin 70 back flush into centering pin aperture 37. Toothpick 20 however, is now engaged by flaps 28 as it attempts to withdraw back into toothpick storage chamber 17. A section of toothpick 20 is now retained stationary outside pen toothpick dispenser 10 where the user can withdraw it with his teeth or fingers. The user is less likely to be poked and injured by toothpick 20 when only a short portion projects outside pen toothpick dispenser 10. The movement of centering pin 70 is directly correlated and synchronized with the telescopic movement of first housing member 12.

A spring biased attachment clip 82 is desirably affixed to the exterior of first housing member 12, or even writing tip protector 66, for temporarily retaining pen toothpick dispenser 10 in a shirt pocket. A further alternative embodiment of pen toothpick dispenser 10 includes a disposable, non-refillable unit in which toothpicks 20 and writing implement 52 cannot be replaced. In this embodiment, snap-on cap 24 would be permanently affixed after the initial addition of toothpicks 20, and writing tip support 54 would also be permanently affixed after installation of writing implement 52.

Preferably toothpick dispenser 10 is manufactured of plastic, utilizing traditional injection molding techniques familiar to those skilled in the art. The specific size of pen toothpick dispenser 10 is noncritical, but is generally to be of a sufficient size to be held comfortably in the user's hand.

Various other methods of carrying out the invention are contemplated as being within the scope of the following claims, although not specifically shown in the drawings. For instance, pen toothpick dispenser 10 can be structured to dispense toothpicks 20 by rotating first housing member 12 in relation to second housing member 14, with compression spring 39 being eliminated. Rotational movement of writing tip support 54 can also be developed which would withdraw writing tip 58 into the interior of writing implement housing 50, thus eliminating the need for writing tip protector 66. These and other such alterations and modifications of pen toothpick dispenser 10 are considered to be part of my invention, insofar as such alterations and modifications are covered by the appending claims.

What I claim as my invention:

1. A toothpick dispenser and writing implement combination, comprising:

an elongated tubular housing sized for hand held usage by a human, said tubular housing having a first end and an oppositely disposed second end, said first end having a plurality of toothpicks within a storage chamber of said tubular housing, said first end having means for dispensing a toothpick of said plurality of toothpicks, said means for dispensing a toothpick having means actuatable by pressing on a top of said first end whereby a single toothpick is dispensed from within said storage chamber through an aperture in said top of said first end, said tubular housing having spring biased means affixed thereto for temporarily retaining said tubular housing in a shirt pocket, said second end of said tubular housing having a writing tip, and means for temporarily covering said writing tip.

* * * * *